US007893893B2

(12) United States Patent
Ku

(10) Patent No.: US 7,893,893 B2
(45) Date of Patent: Feb. 22, 2011

(54) DRIVING ARRANGEMENT FOR AN OLED PANEL

(75) Inventor: Chiung-Ching Ku, Zhubei (TW)

(73) Assignee: Richtek Technology Corp., Hsinchu (TW)

( * ) Notice: Subject to any disclaimer, the term of this patent is extended or adjusted under 35 U.S.C. 154(b) by 1120 days.

(21) Appl. No.: 11/605,487

(22) Filed: Nov. 29, 2006

(65) Prior Publication Data

US 2007/0120782 A1 May 31, 2007

(30) Foreign Application Priority Data

Nov. 30, 2005 (TW) ..... 94142060 A

(51) Int. Cl.
*G09G 3/30* (2006.01)

(52) U.S. Cl. ..... 345/76

(58) Field of Classification Search ..... None
See application file for complete search history.

(56) References Cited

U.S. PATENT DOCUMENTS 7,053,875 B2 * 5/2006 Chou ..... 345/92

* cited by examiner

*Primary Examiner*—Srilakshmi K Kumar
(74) *Attorney, Agent, or Firm*—Rosenberg, Klein & Lee

(57) ABSTRACT

In a driving arrangement for an OLED panel, by using different voltage levels for a gate driver and a source driver, a driving voltage higher than a wafer process voltage is produced for the OLED panel and therefore improves the picture quality.

7 Claims, 6 Drawing Sheets

Prior Art

Prior Art

| | G1 | G2 |
|---|---|---|
| S1 | $V_A = V_{S1} - V_{G1}$<br>$= Vpcs - (-Vmcu)$<br>$= Vpcs + Vmcu$ | $V_B = V_{S1} - V_{G2}$<br>$= Vpcs - (Vpcs - Von)$<br>$= Von$ |
| S2 | $V_C = V_{S2} - V_{G1}$<br>$= Vgnd - (-Vmcu)$<br>$= 0 + Vmcu$<br>$= Vmcu$ | $V_D = V_{S2} - V_{G2}$<br>$= Vgnd - (Vpcs - Von)$<br>$= 0 - Vpcs + Von$<br>$= -Vpcs + Von$ |

| | G1 | G2 |
|---|---|---|
| S1 | $V_A = V_{S1} - V_{G1}$<br>$= Vpcs - (Vpcs - Von)$<br>$= Von$ | $V_B = V_{S1} - V_{G2}$<br>$= Vpcs - (- Vmcu)$<br>$= Vpcs + Vmcu$ |
| S2 | $V_C = V_{S2} - V_{G1}$<br>$= Vgnd - (Vpcs - Von)$<br>$= 0 - Vpcs + Von$<br>$= - Vpcs + Von$ | $V_D = V_{S2} - V_{G2}$<br>$= Vgnd - (- Vmcu)$<br>$= 0 + Vmcu$<br>$= Vmcu$ |

DRIVING ARRANGEMENT FOR AN OLED PANEL

FIELD OF THE INVENTION

The present invention is related generally to an organic light-emitting diode (OLED) display and, more particularly, to a driving arrangement for an OLED panel.

BACKGROUND OF THE INVENTION

FIG. 1 is a diagram of picturing the relationship between the driving voltage and the brightness of an OLED. When an OLED in a panel is applied with a forward voltage higher than a turn-on voltage Von which depends on the panel process, it is turned on and the higher the driving voltage is, the brighter the OLED will be. If the driving voltage is lower than the turn-on voltage Von, either a forward voltage or a backward voltage, the OLED is dark. However, the OLED controller's cost depends on the wafer process. A higher voltage process will have a higher cost.

For more detail, FIG. 2 shows a conventional driving arrangement for an OLED panel, in which power supply 210 may provide a wafer process voltage Vpcs, a microcontroller operation voltage Vmcu, and a ground voltage Vgnd for gate driver 220 and source driver 230. The gate driver 220 and the source driver 230 are connected to each other by several synchronous control signal lines 250, and under the control of controller 260, produce gate signals and source signals to drive OLED panel 240. The gate driver 220 has a high-voltage terminal (Vgh) 222, a low operation voltage terminal (Vdd) 224, and a ground terminal (GND) 226 to receive the voltages Vpcs, Vmcu and Vgnd, respectively, and the source driver 230 has a high-voltage terminal (Vsh) 232, a low operation voltage terminal (Vdd) 234, and a ground terminal (GND) 236 to receive the voltages Vpcs, Vmcu and Vgnd, respectively. Since both the ground terminals 226 and 236 receive zero voltage, i.e. Vgnd=0V, the voltages of the gate driver 220 and the source driver 230 are the same level, and for the OLEDS, the maximum operation voltage, the voltage difference between the voltages of the terminals 232 and 226, is same as the wafer process voltage, which equals to Vpcs and can not be adjusted based on user's requirement. Otherwise, in order to drive the OLED panel 240 to be brighter to thereby have a better displaying quality, it is needed to replace the gate driver 220 and the source driver 230 to provide higher Vpcs to thereby increase the driving voltage for the OLED panel 240, and it increases the cost at the same time.

Therefore, the present invention proposes a driving arrangement which can provide a higher driving voltage than the controller's wafer process voltage to drive an OLED panel.

SUMMARY OF THE INVENTION

An object of the present invention is to provide a driving arrangement for an OLED panel, which could provide higher and adjustable operation voltage than controller's wafer process voltage to drive the OLED panel.

In a driving arrangement for an OLED panel, according to the present invention, a gate driver has a ground terminal connected with a first voltage, a source driver has a ground terminal connected with a second voltage, a power supply provides required voltages of the gate driver and the source driver, and the gate driver and the source driver are connected to each other by capacitors and synchronous control signal lines.

With different voltage levels for the gate driver and the source driver, the driving arrangement of the present invention may produce a driving voltage higher than a wafer process voltage to drive the OLED panel, enhance the brightness and the picture quality of the OLED panel without increasing the cost, and adjust the maximum driving voltage for the OLED panel by defining the voltages provided by the power supply for the gate driver and the source driver.

BRIEF DESCRIPTION OF DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 1:
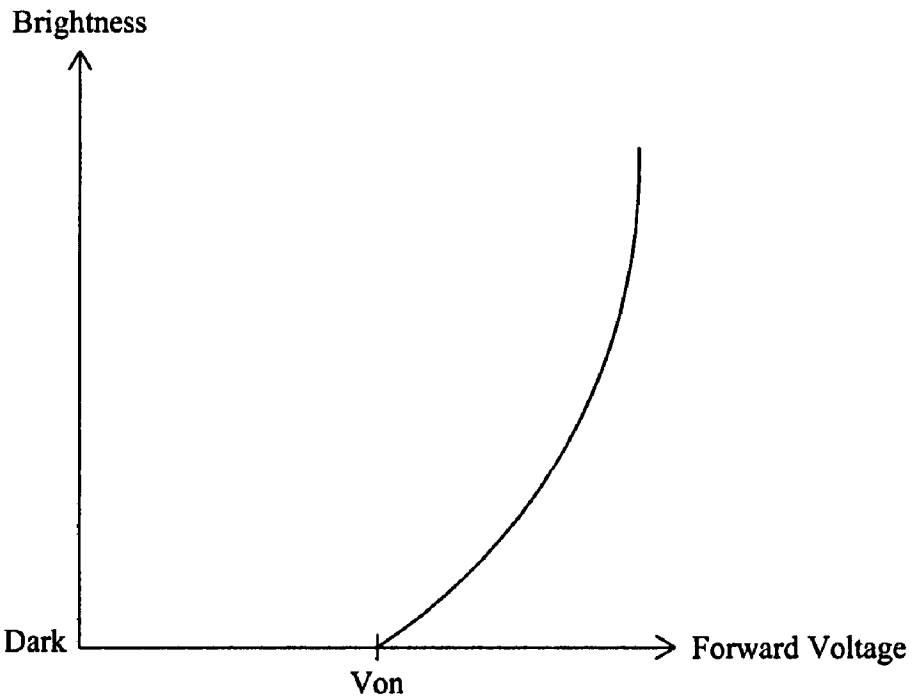
FIG. 1 shows a relationship between the driving voltage and the brightness of an OLED.
Figure 2:
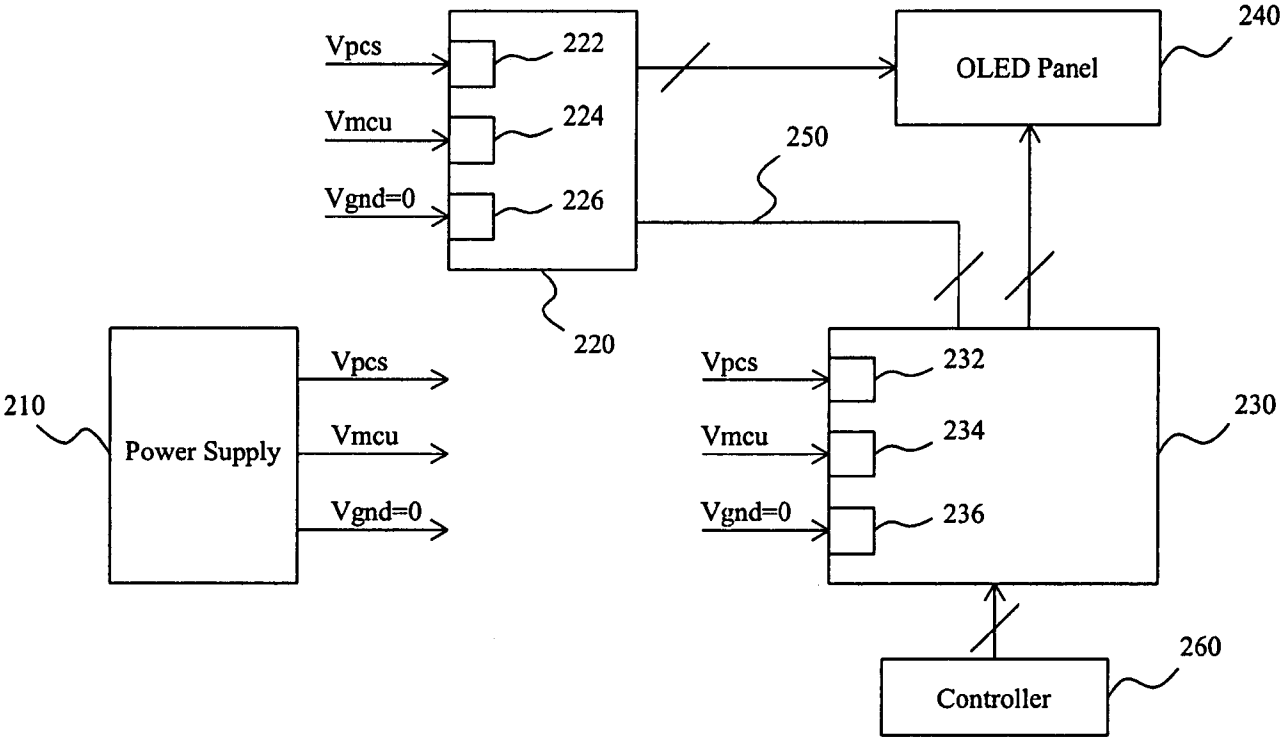
FIG. 2 shows a conventional driving arrangement for an OLED panel.
Figure 3:
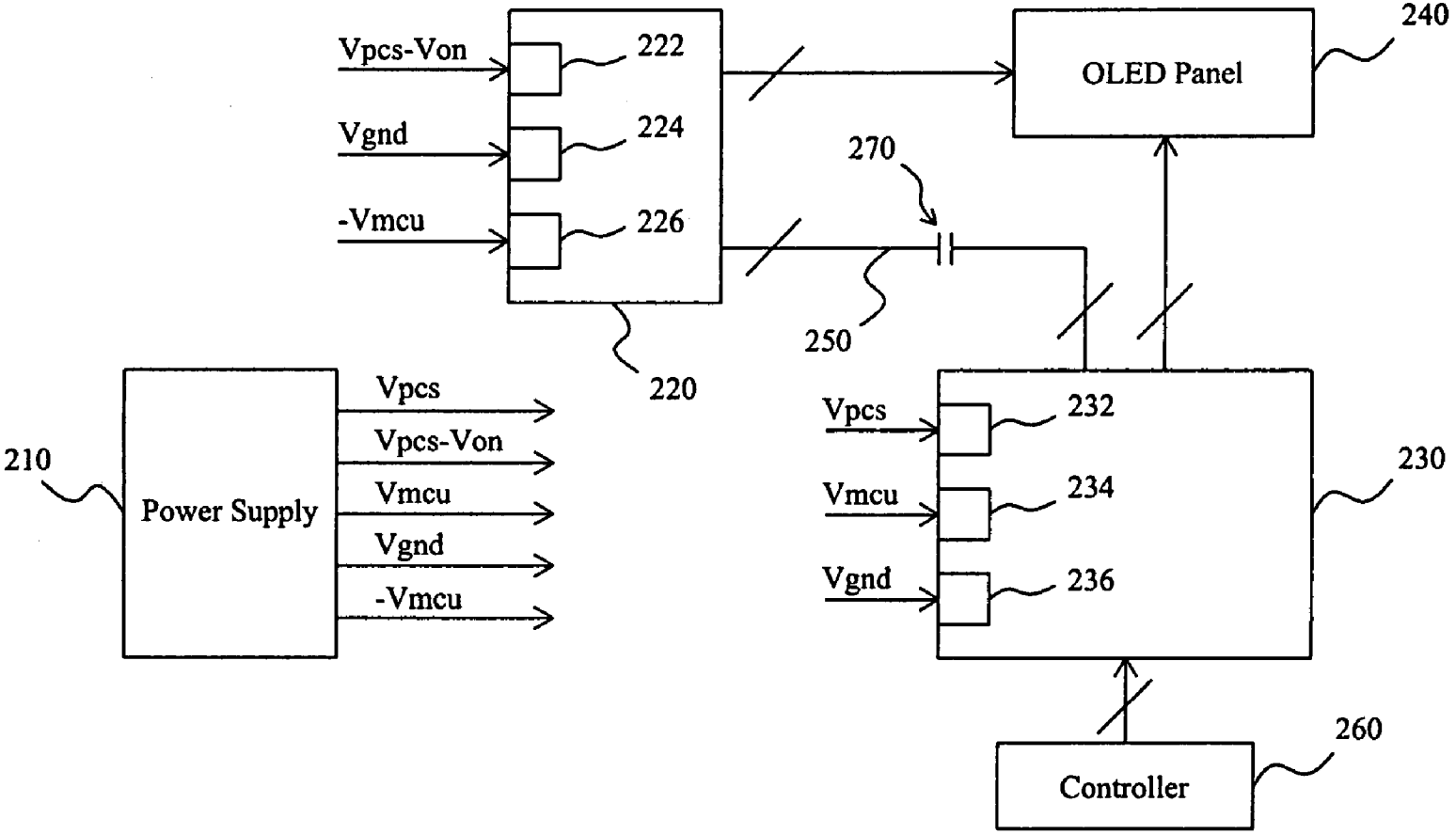
FIG. 3 shows an embodiment according to the present invention.

FIG. 3 shows an embodiment according to the present invention, in which the same reference numerals as used in FIG. 2 refer to the same elements, whereas they are differently configured. In this driving arrangement, power supply 210 provides the voltages Vpcs, Vpcs−Von, Vmcu, Vgnd, and −Vmcu required for gate driver 220 and source driver 230, the gate driver 220 has a high-voltage terminal 222, a low operation voltage terminal 224, and a ground terminal 226 connected with the voltages Vpcs−Von, Vgnd and −Vmcu respectively, and the source driver 230 has a high-voltage terminal 232, a low operation voltage terminal 234, and a ground terminal 236 connected with the voltages Vpcs, Vmcu and Vgnd respectively. Since the ground terminal 236 of the gate driver 220 receives the negative microcontroller operation voltage −Vmcu, instead of zero voltage, the difference between the high voltage and the low voltage of the gate driver 220, the voltage of the high-voltage terminal 222—the voltage of the ground terminal 226, will be (Vpcs−Von)−(−Vmcu)=Vpcs−Von+Vmcu. Typically, the turn-on voltage Von is equal to the microcontroller operation voltage Vmcu, and therefore the difference between the high voltage and the low voltage of the gate driver 220 will be Vpcs. Similarly, the difference between the high voltage and the low voltage of the source driver 230, the voltage of the high-voltage terminal 232—the voltage of the ground terminal 236, is Vpcs−Vgnd. Usually, the voltage Vgnd is 0V, and therefore the difference between the high voltage and the low voltage of the source driver 230 is also equal to Vpcs. However, the voltages of the ground terminals 226 and 236, i.e. the reference voltages, are different, and then the gate driver 220 and the source driver 230 will have different voltage levels. Further, the gate driver 220 and the source driver 230 are connected to each other by capacitors 270 and synchronous control signal lines, and under the control of controller 260, produce the gate signals and the source signals to drive OLED panel 240. When the gate driver 220 and the source driver 230 receive the signals from the controller 260 to turn on the OLEDS in the panel 240, the maximum driving voltage for the OLED panel 240 is the difference between the voltage of the high-voltage terminal 232—the voltage of the ground terminal 226, i.e., Vpcs−(−Vmcu)=Vpcs+Vmcu, which is higher than the wafer process voltage Vpcs of the gate driver 220 and the source driver 230. Therefore, it can produce higher driving voltage to increase the brightness of the OLED panel 240 without changing the gate driver 220 and the source driver 230. In other words, the OLED panel 240 can have better picture quality without increasing the cost. In other embodiments, the power supply 210 can be defined to provide different voltages for the gate driver 220 and the source driver 230 such that the maximum driving voltage for the OLED panel 240 is adjusted, and the flexibility of the driving arrangement is improved.

Figure 4:
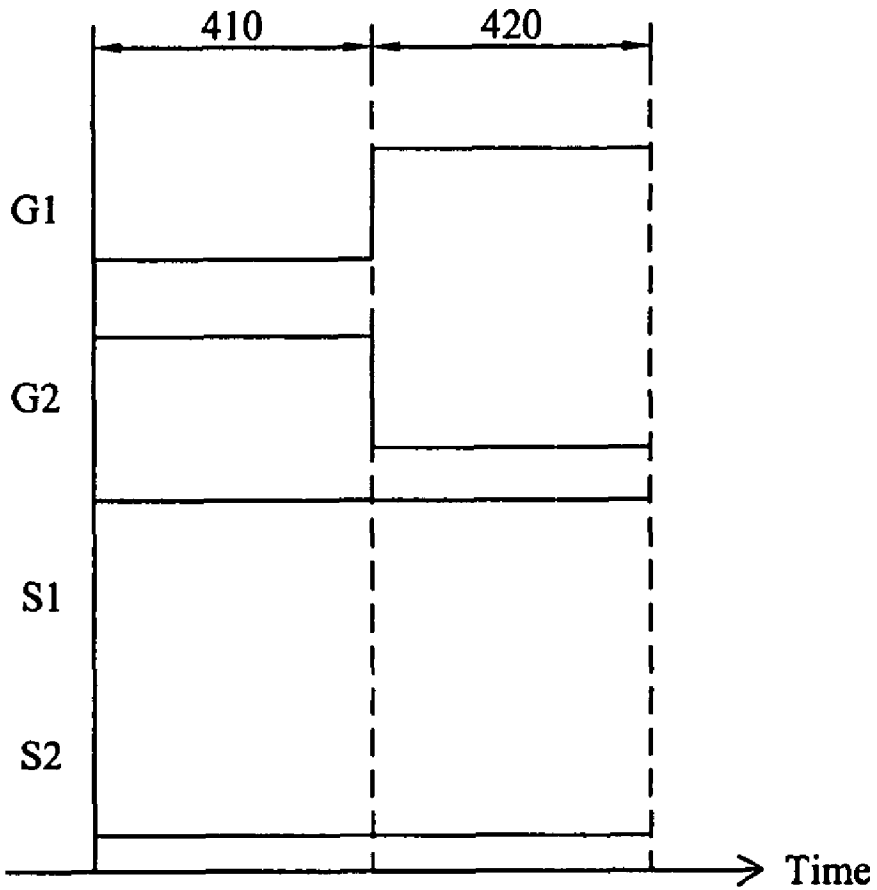
FIG. 4 is a timing diagram of the gate driver and the source driver of the driving arrangement shown in FIG. 3.
Figure 5:
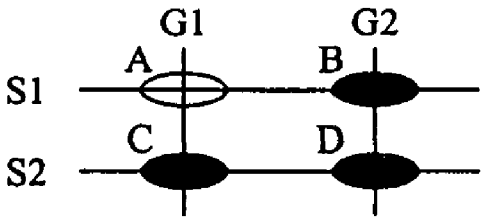
FIG. 5 shows the calculated voltages in a first phase based on the timing diagram of FIG. 4.
Figure 6:
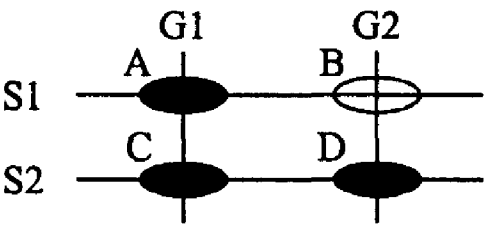
FIG. 6 shows the calculated voltages in a second phase based on the timing diagram of FIG. 4.

FIG. 4 is a timing diagram of the gate driver 220 and the source driver 230. During time period 410, a first gate G1 and a second gate G2 of the gate driver 220 have the voltages −Vmcu and Vpcs−Von, respectively, and a first source S1 and a second source S2 of the source driver 230 have the voltages Vpcs and Vgnd, respectively. Since a driving voltage is the difference between a gate voltage and a source voltage, as shown in FIG. 5, there are four driving voltages $V_A$, $V_B$, $V_C$ and $V_D$ corresponding to the points A, B, C and D at the intersections of the gates G1 and G2 and the sources S1 and S2. During the time period 410, $V_A$ is a forward voltage and higher than the turn-on voltage Von, and the OLED at the point A is lighted. $V_B$ and $V_C$ are forward voltages but not higher than the turn-on voltage Von, and the OLEDS at the points B and C are dark. $V_D$ is a backward voltage, and the OLED at the point D is dark. As shown in FIG. 4, during the subsequent time period 420, the voltage of the gate G1 is switched to Vpcs−Von, the voltage of the gate G2 is switched to −Vmcu, and the voltages of the sources S1 and S2 remain at Vpcs and Vgnd respectively. In this case, the driving voltages $V_A$, $V_B$, $V_C$ and $V_D$ at the points A, B, C and D are shown in FIG. 6. $V_A$ is a forward voltage but not higher than the turn-on voltage Von, and the OLED at the point A is dark. $V_B$ is a forward voltage and higher than the turn-on voltage Von, and the OLED at the point B is lighted. $V_C$ is a backward voltage, and the OLED at the point C is dark. $V_D$ is a forward voltage but not higher than the turn-on voltage Von, and the OLED at the point D is dark. With the drivers 220 and 230 manufactured by 0.35 μm and 18V wafer process to drive the OLED panel 240 having the turn-on voltage of 3V for example, Vpcs=18V, Vmcu=3V, Von=3V, and Vgnd=0V. During the time period 410, $V_A$, $V_B$, $V_C$ and $V_D$ are 21V, 3V, 3V and −15V, respectively, and during the time period 420, $V_A$, $V_B$, $V_C$ and $V_D$ are 3V, 21V, −15V, and 3V, respectively. It is shown that the driving voltage at the lighted point, such as $V_A$ at the point A during the time period 410, is 21V and higher than the wafer process voltage Vpcs (18V). Therefore, it could produce higher driving voltage without changing the drivers 220 and 230, to increase the brightness of the OLED panel 240 and produce a better picture quality with a lower cost.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A driving arrangement for an OLED panel, comprising:

a gate driver having a ground terminal connected with a first voltage;

a source driver having a ground terminal connected with a second voltage; and a power supply for providing required voltages for the gate driver and the source driver, the required voltages include a wafer process voltage, a difference between the wafer process voltage and a turn-on voltage of the OLED panel, a microcontroller operation voltage, a ground voltage, and a negative microcontroller operation voltage;

wherein the gate driver and the source driver have different voltage levels and are connected to each other by capacitors and synchronous control signal lines.

2. The driving arrangement of claim 1, wherein the first voltage is the negative microcontroller operation voltage.

3. The driving arrangement of claim 1, wherein the gate driver further has a high-voltage terminal connected with the difference between the wafer process voltage and the turn-on voltage of the OLED panel.

4. The driving arrangement of claim 1, wherein the gate driver further has a low operation voltage terminal connected with the ground voltage.

5. The driving arrangement of claim 1, wherein the second voltage is the ground voltage.

6. The driving arrangement of claim 1, wherein the source driver further has a high-voltage terminal connected with the wafer process voltage.

7. The driving arrangement of claim 1, wherein the source driver further has a low operation voltage terminal connected with the microcontroller operation voltage.

* * * * *